US007699173B2

(12) United States Patent
Hession

(10) Patent No.: US 7,699,173 B2
(45) **Date of Patent: *Apr. 20, 2010**

(54) CHILD RESISTANT BLISTER PACKAGE

(75) Inventor: Christopher J. Hession, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 903 days.

This patent is subject to a terminal disclaimer.

(21) Appl. No.: 10/556,263

(22) PCT Filed: May 12, 2004

(86) PCT No.: PCT/US2004/015113

§ 371 (c)(1),
(2), (4) Date: Nov. 14, 2005

(87) PCT Pub. No.: WO2004/101386

PCT Pub. Date: Nov. 25, 2004

(65) Prior Publication Data

US 2006/0249420 A1 Nov. 9, 2006

Related U.S. Application Data

(60) Provisional application No. 60/469,721, filed on May 12, 2003.

(51) Int. Cl.
*B65D 83/04* (2006.01)
*B65D 85/42* (2006.01)
*B65D 73/00* (2006.01)

(52) U.S. Cl. ..... 206/531; 206/532; 206/462; 206/469

(58) Field of Classification Search ..... 206/528–532, 206/534–534.2, 538, 539, 461, 462, 467, 206/469, 471; 221/302, 305; 229/87.2, 92.2
See application file for complete search history.

(56) References Cited

U.S. PATENT DOCUMENTS

| | | | | |
|---|---|---|---|---|
| 3,820,655 | A * | 6/1974 | La Tourette et al. | 206/532 |
| 4,520,930 | A * | 6/1985 | Lisiecki | 229/103.1 |
| 5,954,202 | A * | 9/1999 | Mellon | 206/462 |
| 6,161,699 | A * | 12/2000 | Gartland | 206/531 |
| 6,659,280 | B2 * | 12/2003 | Paliotta et al. | 206/531 |
| 6,951,282 | B2 | 10/2005 | Jones | |
| 2003/0006163 | A1 | 1/2003 | Patterson | |
| 2003/0213721 | A1 | 11/2003 | Jones | |
| 2006/0138015 | A1 | 6/2006 | Freeze | |
| 2006/0289328 | A1 | 12/2006 | Hession | |

* cited by examiner

*Primary Examiner*—Mickey Yu
*Assistant Examiner*—Melissa L Lalli
(74) *Attorney, Agent, or Firm*—Tsugihiko Suzuki; Alison R. Scheidler

(57) ABSTRACT

The invention provides a substantially child resistant package. A gate panel (110) and a tab panel (130) are secured to an aperture panel (130). At least one aperture (123) is formed on the aperture panel. At least one gate (114) is formed on the gate panel and is aligned with the aperture when the gate panel is in contact with the aperture panel. At least one partially detachable tab (136) is formed on the tab panel and is aligned with the gate when the tab panel is in contact with the gate panel. In an exemplary package, a blister is aligned with and secured to the aperture panel. The gate panel is folded and secured to the aperture panel and blister package. The tab panel is folded and covers at least some portion of the gate panel.

16 Claims, 10 Drawing Sheets

Prior Art

CHILD RESISTANT BLISTER PACKAGE

RELATED APPLICATIONS

This application claims priority to U.S. Application No. 60/469,721, filed May 12, 2003, the entirety of which is hereby incorporated by reference.

BACKROUND OF THE INVENTION

This invention relates to a child resistant package, such as pharmaceutical package.

It is well known to use a blister package to contain items such as pharmaceutical pills or other suitable items. A conventional blister package 10 includes a blister base 11, blister cells 20, a product 30 and a backing layer 40 as illustrated in FIGS. 1-3. The base 11 and cells 20 are typically formed from a substrate such as a thermo-formed plastic. Typically after a product 30, such as a pill or other suitable product, is placed in the blister cells 20, a backing layer 40 such as foil, paperboard or other suitable material is secured to the base 11 to cover the open area of the blister cells 20 as illustrated in FIGS. 2 and 3. A product 30 is typically removed from a blister cell 20 by applying pressure or other suitable manipulation of the cell 20 to create an opening, such as a tear or rupture in the backing layer 40.

Typically when the backing layer 40 is strong or rigid, for example a paperboard material, gates (not shown) are other suitable weakened areas are formed in the backing layer 40 in the general vicinity of each blister cells 20 to assist with removing the product 30 through the backing layer 40. A gate (not shown) must be deformed or manipulated to prior to removal of the product 30 through the backing layer 40.

While conventional blister packages 10 are suitable for many applications there are several deficiencies in their design. While they provide easy removal of the product 30 as described above, they offer very little resistance for children accessing the product 30. Child resistance is a feature that is particularly desired for unit dose pharmaceutical packaging. Various regulations or guidelines are prescribed for making packages child resistant. In general, a child resistant package must be designed and operationally tested to ensure that the package offers sufficient resistance to children accessing the product. While child resistance is an important feature, however, it is also desirable that a package be designed so that adults can open a package with minimal instructions. Furthermore it is desirable that a package can be opened by adults lacking manual dexterity or strength. Based on at least the above deficiencies in the prior art, what is needed is a child resistant package.

SUMMARY OF THE INVENTION

The invention provides a substantially child resistant package. A gate panel and a tab panel are secured to an aperture panel. At least one aperture is formed on the aperture panel. At least one gate is formed on the gate panel and is aligned with the aperture when the gate panel is in contact with the aperture panel. At least one partially detachable tab is formed on the tab panel and is aligned with the gate when the tab panel is in contact with the gate panel. In an exemplary package, a blister package is aligned with an secured to the aperture panel. The gate panel is folded and secured to the aperture panel and blister package. The tab panel is folded and covers at least some portion of the gate panel.

BRIEF DESCRIPTION OF THE FIGURES

Other features of the invention will become more apparent in the description below contain herein and can be further understood by reading the accompanying figures, wherein like characters represent like parts throughout the several views.

DESCRIPTION OF THE INVENTION

Figure 4:
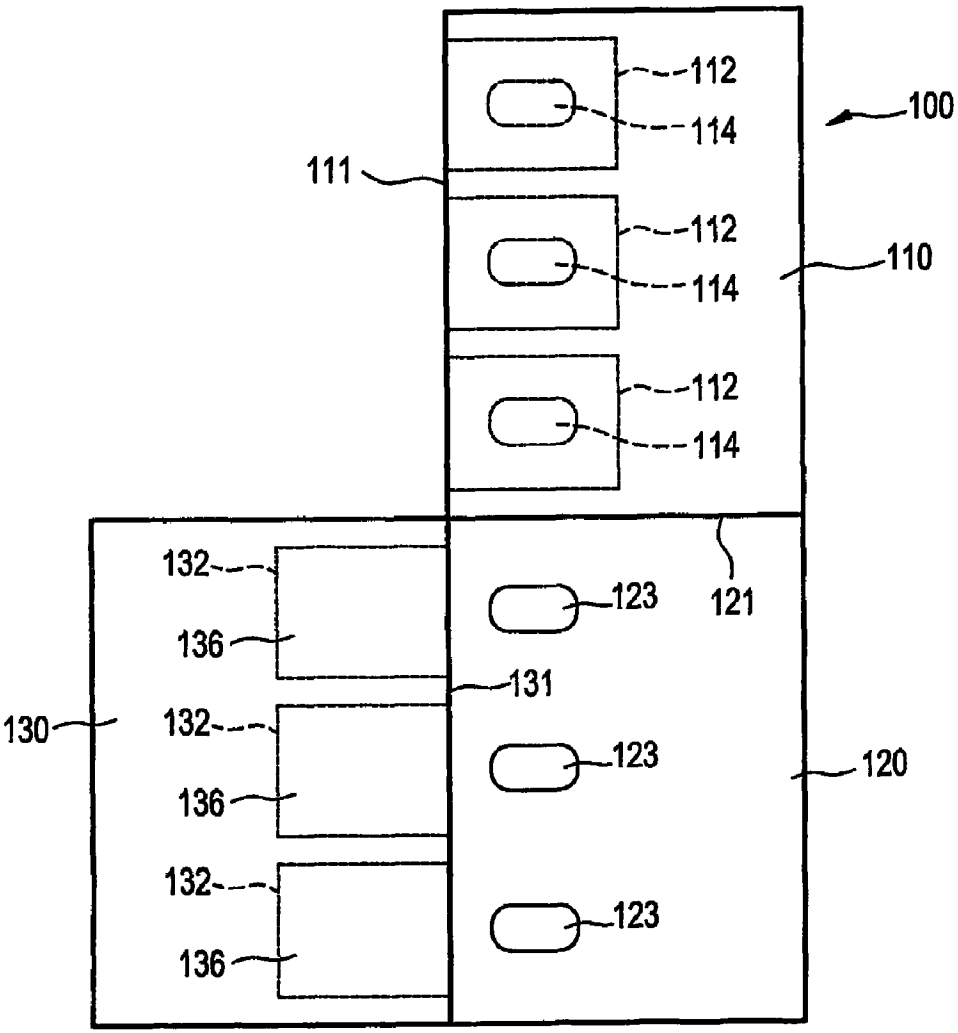
FIG. 4 is a plan view of a package blank according to the invention.

FIG. 4 illustrates a plan view of an exemplary packaging blank 100 according to the invention. An exemplary embodiment of a blank 100 according to the invention is illustrated with a gate panel 110, an aperture panel 120 and a tab panel 130. The gate panel 110 is exemplary secured to the aperture panel 120 along perimeter 121. The tab panel 130 is secured to the aperture panel 120 along perimeter 131. In an exemplary method the panels 110, 120, 130 are formed from the same substrate; however they could be formed from separate substrates. It is to be understood that the layout, dimensions, shape and method of forming the panels 110, 120, 130 are exemplary and variations of the above are within the scope of the invention. For example, the panels 110, 120, 130 could be separate substrates that are secured to each other in a manner consistent with the method described below.

Figure 1:
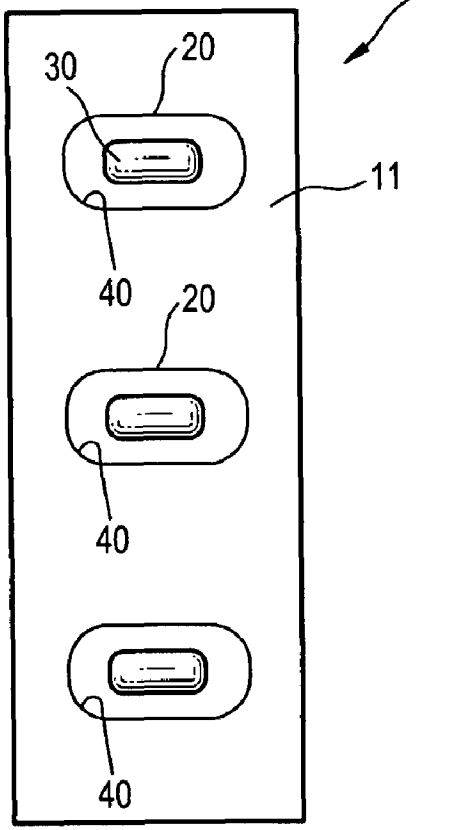
FIG. 1 is a top plan view of a conventional blister package.
Figure 2:
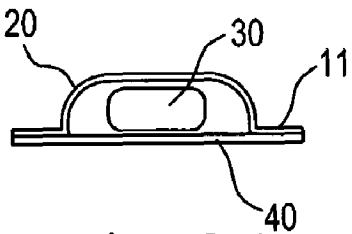
Prior Art FIG. 2
FIG. 2 is a elevation view of FIG. 1.
Figure 3:
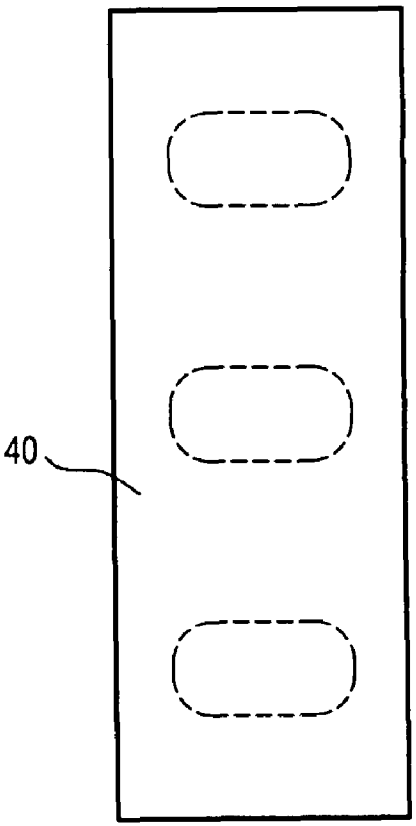
Prior Art FIG. 3
FIG. 3 is a bottom plan view of FIG. 1.

The aperture panel 120 is illustrated with exemplary apertures 123. The apertures are designed and laid out to support a blister package such as the conventional blister package illustrated in FIGS. 1-3. It is to be understood that a wide variety of configurations and shapes are within the scope of the invention. The gate panel 110 is illustrated with exemplary gates 114. An exemplary gate boundary 112 is illustrated surrounding the gates 114. In an exemplary method the gate 114 and gate boundary 112 can be formed by partial die cut or other suitable means. The gate boundary 112 is designed to substantially align with the detachable tabs 136 of the tab panel 120 as will be more fully illustrated in FIGS. 7 and 9. The perimeter 111 of the gate panel 110 is illustrated as a straight line; however it is to be understood that the shape of the perimeter 111 could be altered to aid with opening a formed package. One such shape could be a non-linear curved pattern. The tab panel 130 is illustrated with a plurality of at least partially detachable tabs 136 with a tab perimeter 132. In an exemplary method the tab perimeter can be formed by partial die cuts or other suitable means. It is to be understood that the tabs 136 could also be removable. In addition the perimeter between the tab panel 130 and aperture panel 120 can likewise be shaped (not shown) to aid with opening a formed package. One such shape could be a non-linear curved pattern.

The panels 110, 120, 130 may be formed from any suitable substrate material to include conventional paperboard grades, for example solid bleached sulfate (SBS) paperboard ranging in weight of about 10 point or greater. An exemplary substrate 100 includes a 12-point SBS board manufactured by MeadWestvaco Corporation. The substrate 100 may also be a laminated board, a coated board, an unbleached board, or a synthetic paper depending on the desired appearance of the package. An exemplary substrate has at least one side that is compatible with a printing method. The other side should be suitable for an adhesive coating. Any suitable means for securing the panels 110, 120, 130 to each other and to secure the blister pack 10 is within the scope of the invention. An exemplary substrate is a board coated on one side with Easy Seal Plus® adhesive manufactured by MeadWestvaco Corporation. The panels 110, 120, 130 should ideally be arranged and secured to each other so that a formed package would have printing on at least some part of the exterior of the package.

Figure 6:
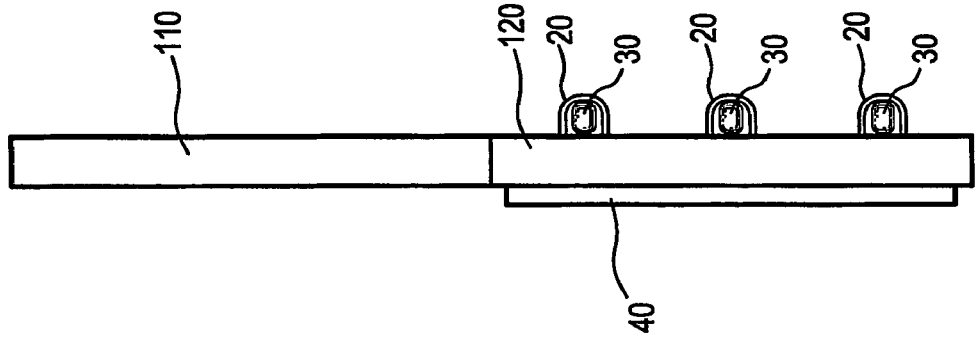
FIG. 6 is a side view of FIG. 5.
Figure 5:
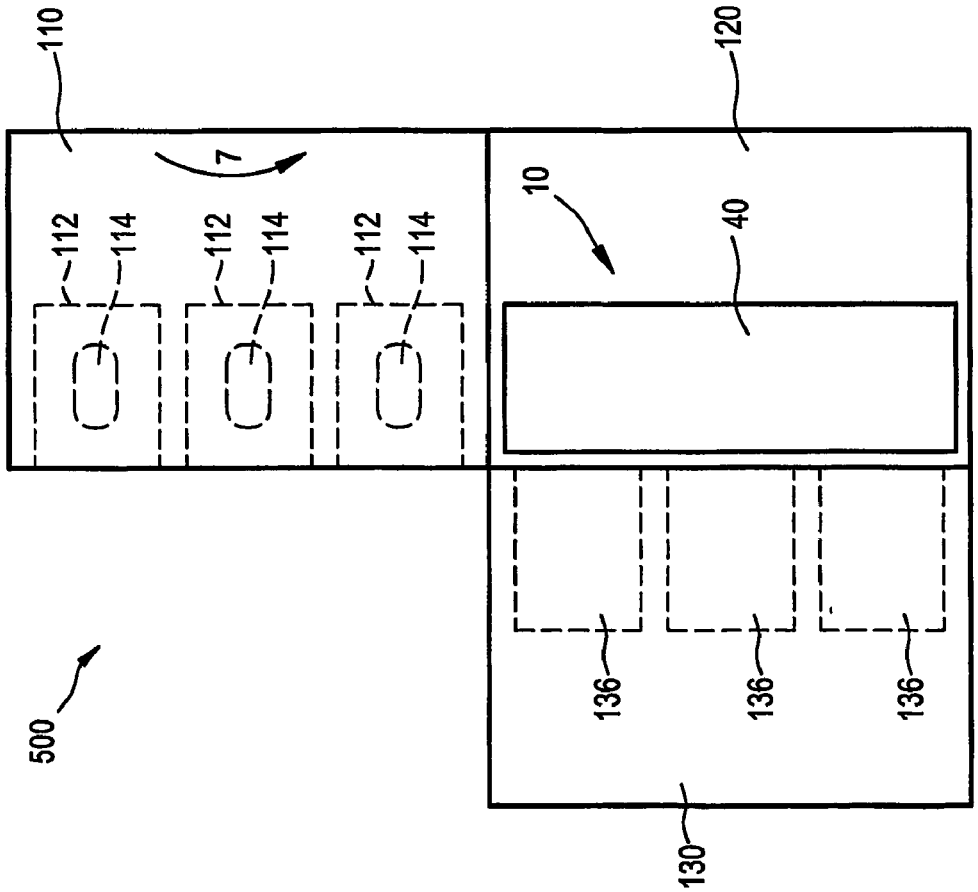
FIG. 5 is a plan view of a blister package inserted into the blank of FIG. 4.

FIGS. 5-6 illustrate a package 500 after the blister package 10 is secured to the aperture panel 120. FIG. 6 illustrates that the blister cells partially extending through the apertures 123. Direction arrow 7 illustrates an exemplary direction and method of folding the gate panel 110 to substantially cover the backing layer 40 of the blister pack 10. It is to be understood that the gates 114 are dimensioned and aligned to fit substantially over the backing layer 40 in the vicinity of the perimeter of the blister cells 20. In an exemplary embodiment, the gate panel is secured to the backing layer 40 and aperture panel 120. If the panels 110, 120, 130 have an exemplary adhesive coating, the gate panel 110 and aperture panel 120 can be secured to each other by heating and pressing the panels 110, 120 together. It is to be understood that any suitable method of securing the panels is within the scope of the invention.

Figure 8:
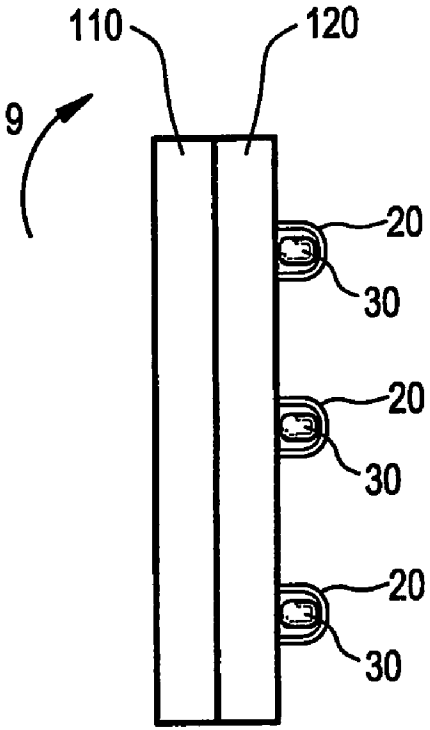
FIG. 8 is a side view of FIG. 7.
Figure 7:
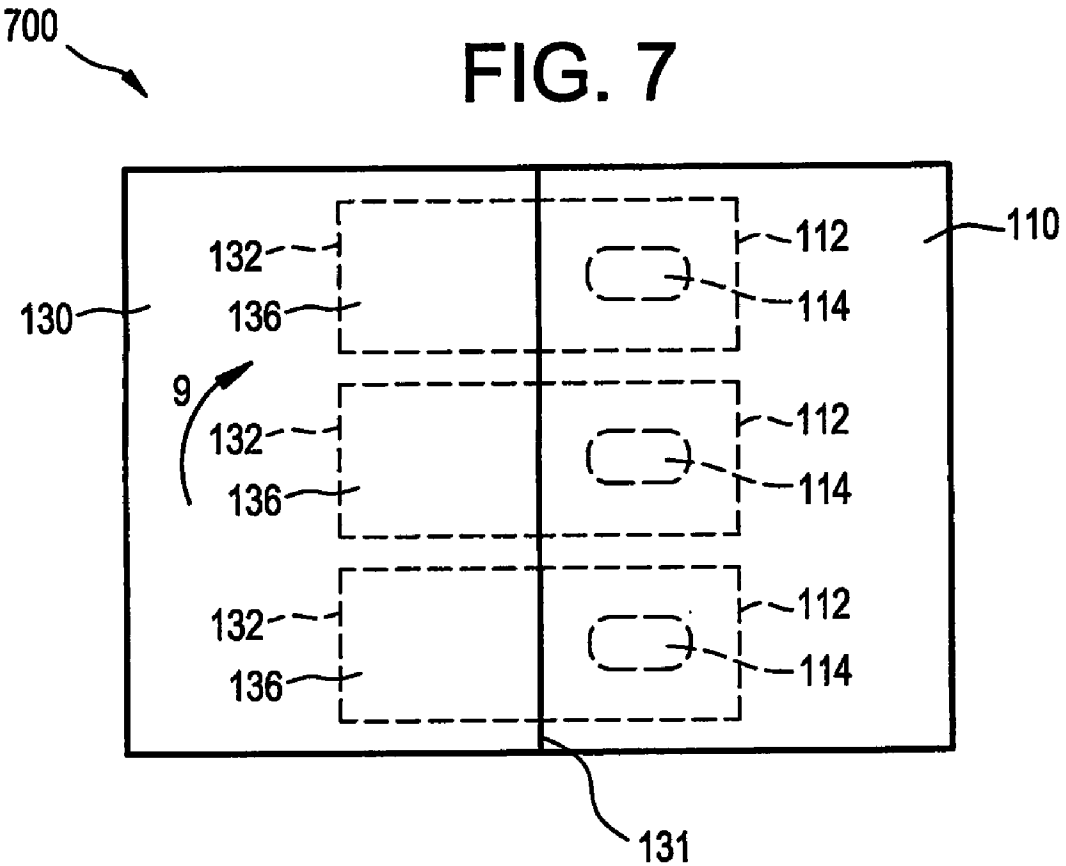
FIG. 7 is a plan view after folding the gate panel of FIG. 5.

FIGS. 7-8 illustrate a package 700 after the gate panel 110 is at least partially secured to the aperture panel 120. Direction arrow 9 illustrates an exemplary direction and method of folding the tab panel 130 to substantially cover the gate panel 110. It is to be understood that the tabs 136 are dimensioned and aligned to fit substantially over the gate 114 and gate boundary 112. In an exemplary embodiment, the tab panel 130 is secured to the gate panel 110. It is to be understood that any suitable method of securing the panels is acceptable.

Figure 10:
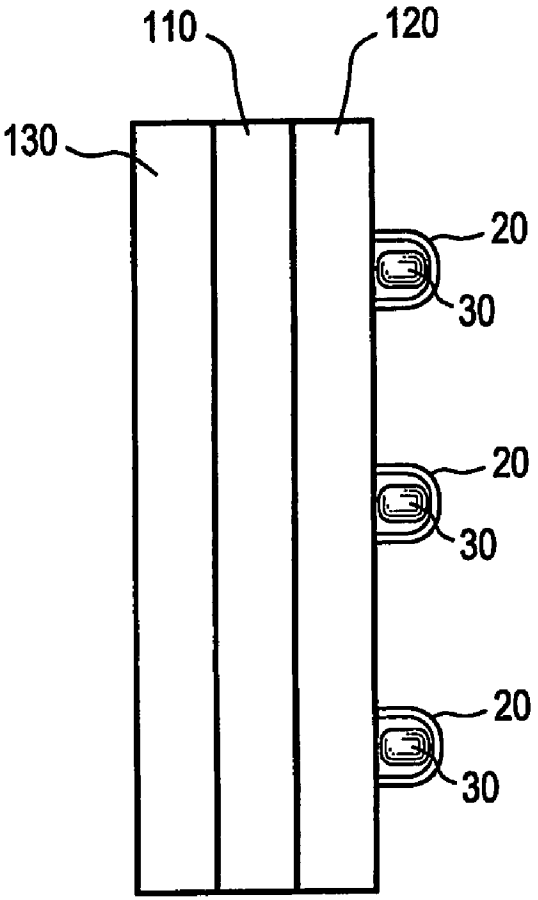
FIG. 10 is a side view of FIG. 9.
Figure 9:
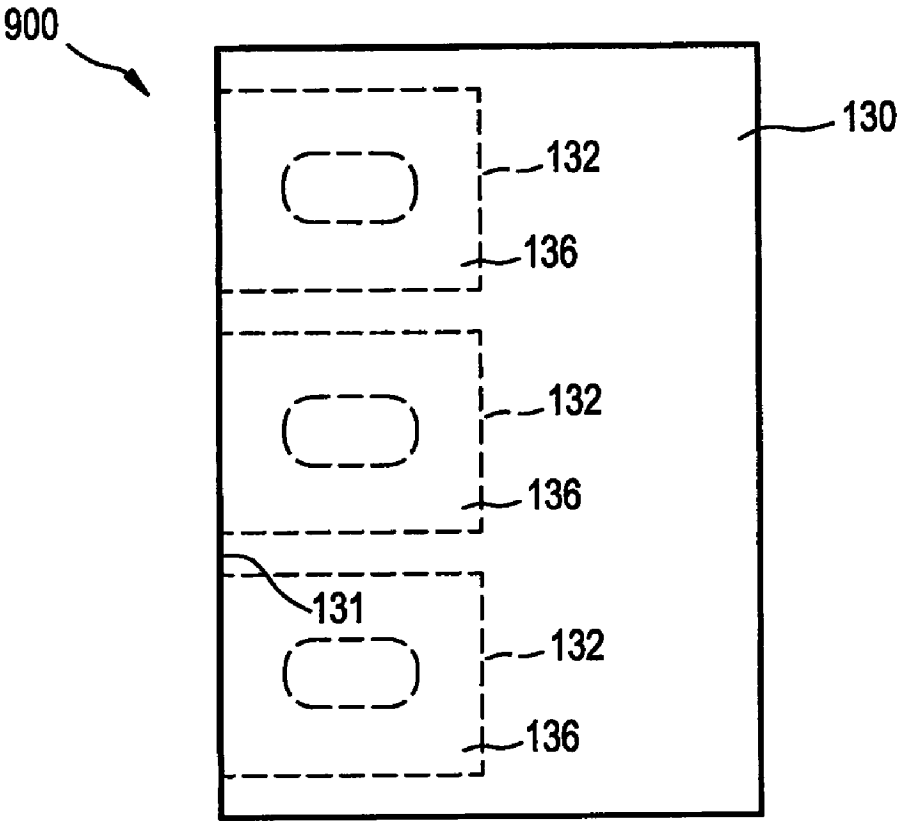
FIG. 9 is a plan view after folding the tab panel of FIG. 7.

FIGS. 9-10 illustrates a package 900 after the tab panel 130 is secured to the gate panel 110. It is to be understood that the package 900 could be placed into a container or carton. It could also be place inside a full or partial sleeve (not shown). It could also be wrapped (not shown) with a shrink-wrap material, such as plastic or any other suitable material or means.

Figure 11:
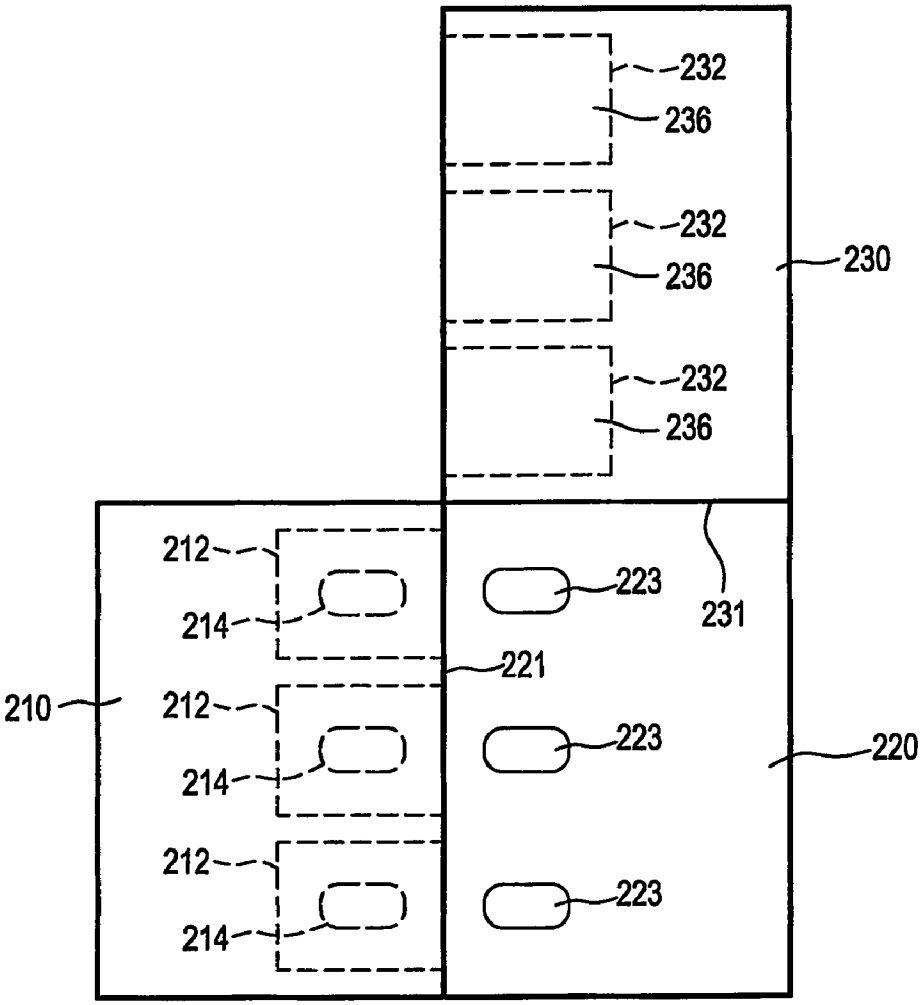
FIG. 11 is a plan view of another embodiment according to the invention.

FIG. 11 illustrates another exemplary embodiment according to the invention. The gate panel 210 is illustrated opposing an aperture panel 220. A tab panel 230 is illustrated secured to the aperture panel 220. It is to be understood that the gate panel 210 and tab panel 230 should be folded and secured to the aperture panel 220 in a method similar to that described above. The gate panel 210 further defines at least one gate boundary 212, at least one corresponding gate 214, and a gate panel perimeter 221. The aperture panel 220 further defines at least one aperture 223. Furthermore, the tab panel 230 defines a tab panel perimeter 231 and at least one tab 236 within such tab panel perimeter 231. Each tab 236 has a corresponding tab perimeter 232.

Figure 12:
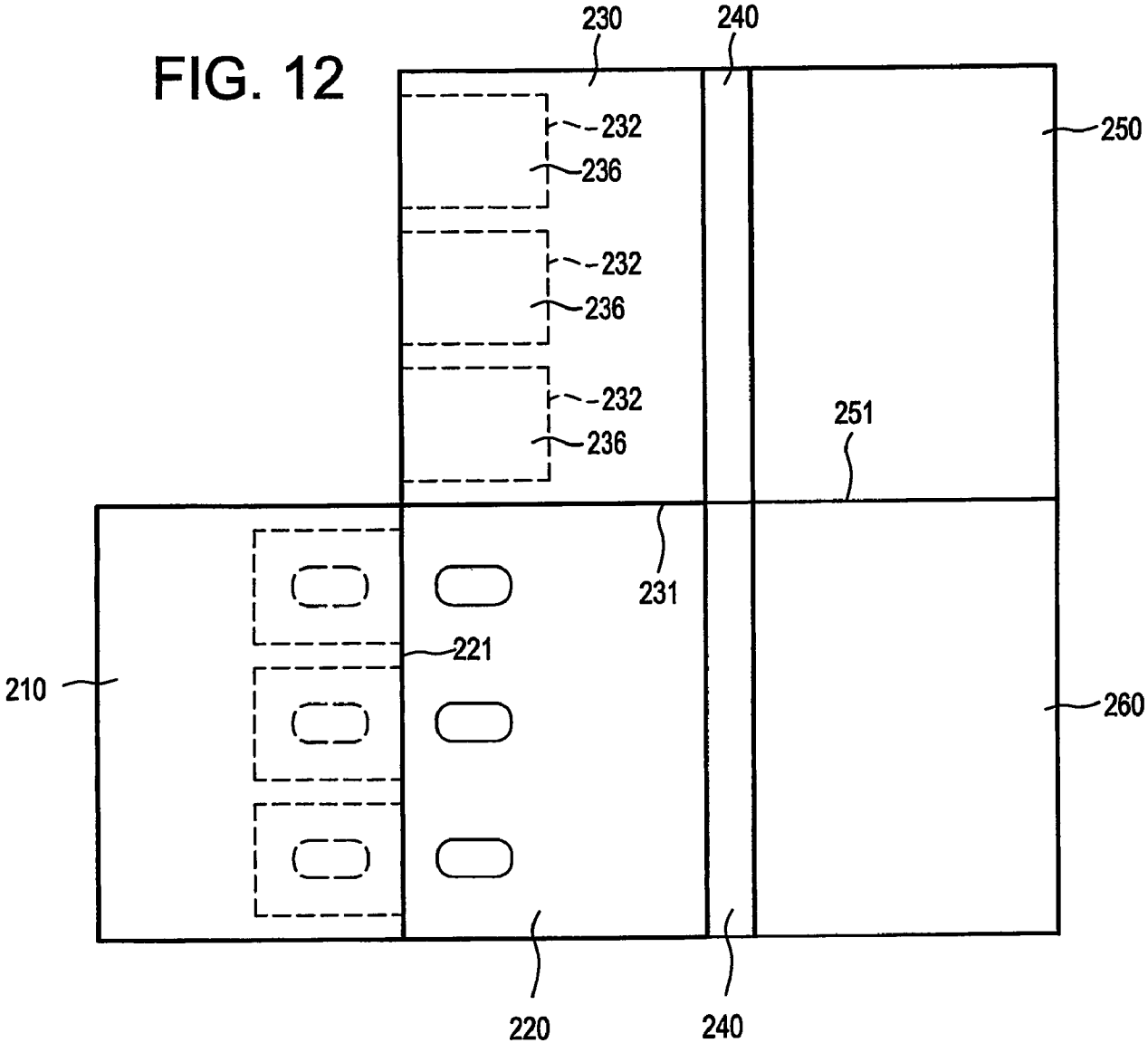
FIG. 12 is a plan view of another embodiment according to the invention.

FIG. 12 illustrates yet another embodiment according to the invention. Two exemplary display panels 250, 260 are illustrated secured to panel 220, 230 via optional hinge panels 240. It is to be understood that the display panels 250, 260 could contain printed information. They could also support and retain an informational guide such as a booklet, as well as media device such as CD Rom or DVD, as well as a media device retention device such as a hub. Additional display panels (not shown) could also be configured in numerous ways. The scope of the invention includes any suitable configuration of the display panels 250, 260 for any suitable purpose.

Figure 13:
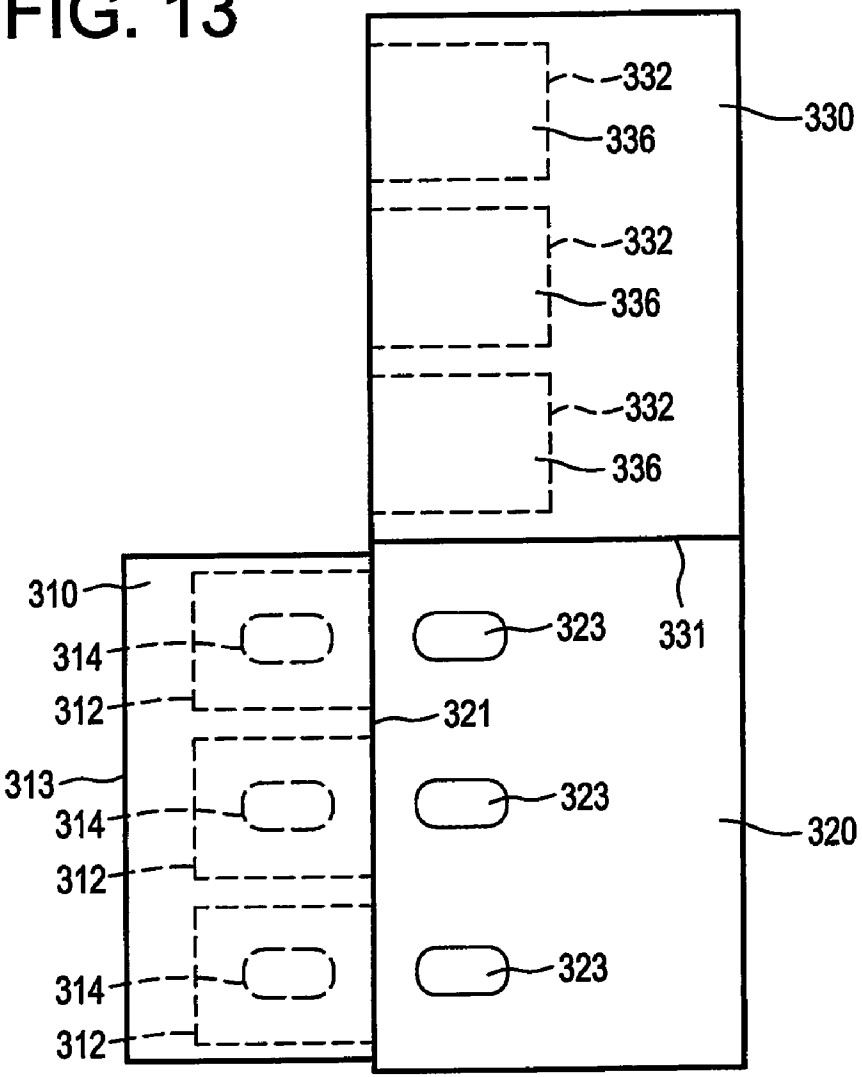
FIG. 13 is a plan view of another embodiment according to the invention.

FIG. 13 illustrates another exemplary embodiment according to the invention. The gate panel 310 is illustrated opposing an aperture panel 320. A tab panel 330 is illustrated secured to the aperture panel 320. In this embodiment, the gate panel 310 is illustrated as being smaller than the aperture panel 320. The gate panel 310 further defines at least one gate boundary 312, at least one corresponding gate 314, and a gate panel perimeter 321. The aperture panel 320 further defines at least one aperture 323. Additionally, the tab panel 330 further defines a tab panel perimeter 331 and at least one tab 336 within such tab panel perimeter 331. Each tab 336 has a corresponding tab perimeter 332.

Figure 14:
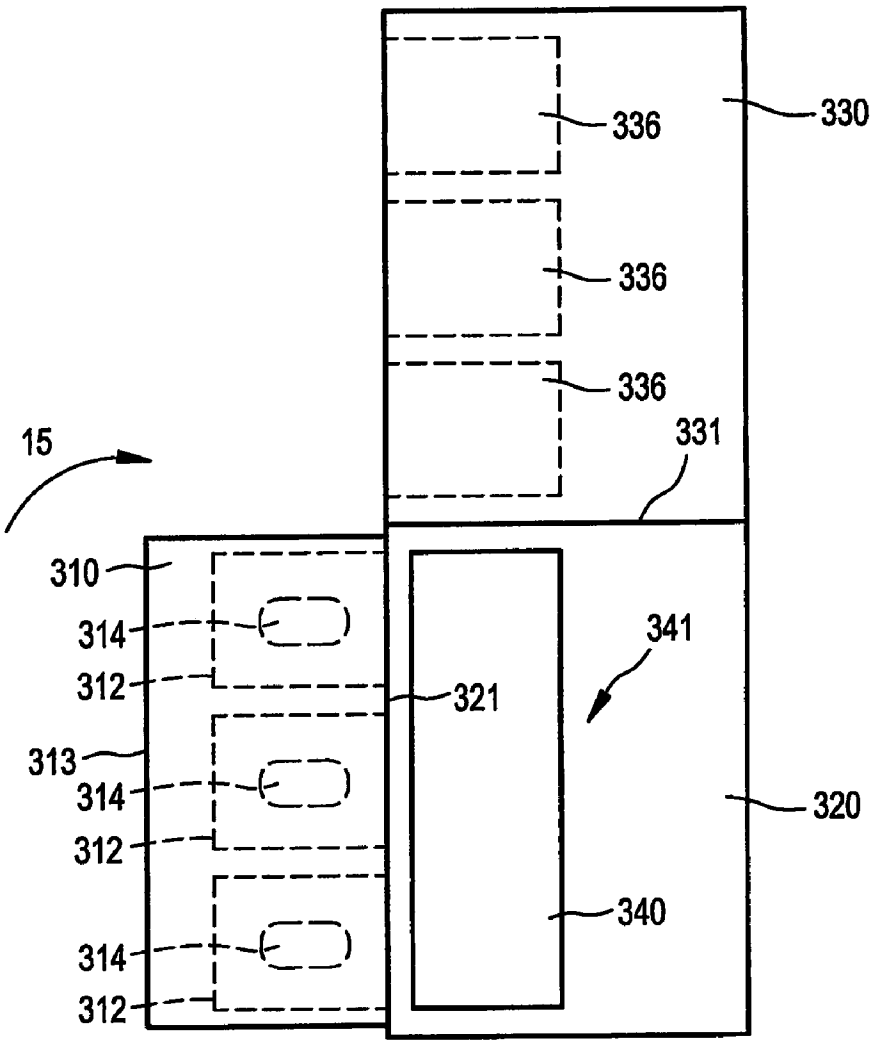
FIG. 14 is a plan view after a blister package is placed on the substrate.

FIGS. 14 illustrates a blister package 341 secured to the aperture panel 320. Direction arrow 15 illustrates an exemplary direction and method of folding the gate panel 310 to substantially cover the backing layer 340 of the blister package 341. It is to be understood that the gates 312 are dimensioned and aligned to fit substantially over the backing layer 340 in the vicinity of the perimeter of the blister cells (not shown). In an exemplary embodiment, the gate panel 310 is secured to the backing layer 340 and aperture panel 320. It is to be understood that any suitable method of securing the panels is within the scope of the invention.

Figure 15:
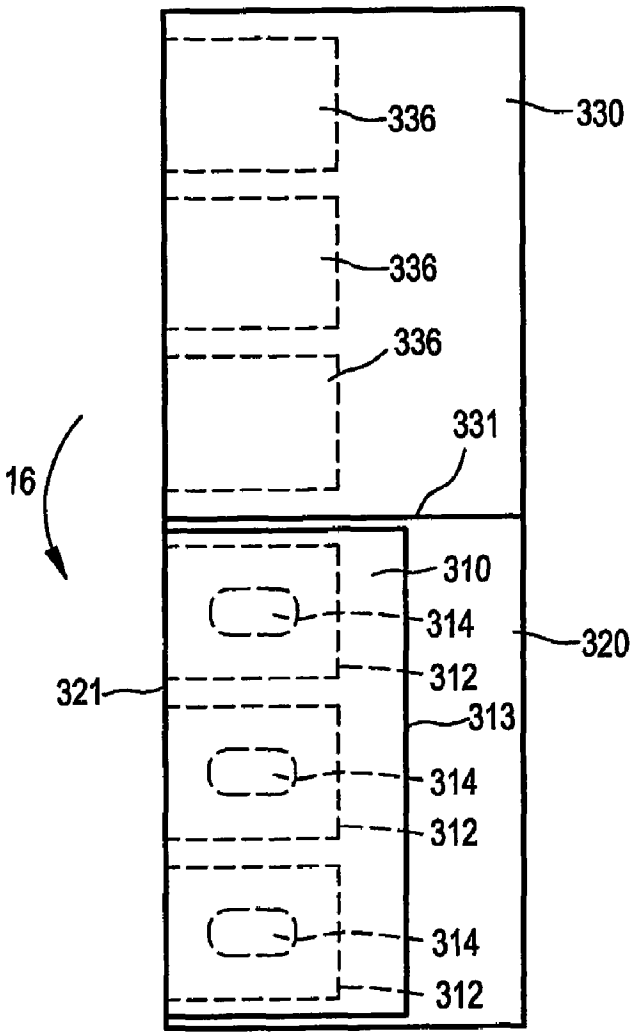
FIG. 15 is a plan view after folding the tab panel.

FIG. 15 illustrates the gate panel 310 covering the backing layer 340 (not visible). It is to be understood that the tab panel 330 could be folded in the direction of the arrow 16 and secured (not shown) to the aperture panel 320 in a method similar to that described above. If the gate panel 310 is smaller than the aperture panel 320, then the tab panel 330 can be secured to at least some portion of the aperture panel 320 using any suitable means. It is to be understood that the tab panel 330 can be also secured to at least some portion of the gate panel 310 as well.

Once given the above detailed description of the invention, many other features, modifications or embodiments of the invention will become apparent to one skilled in the art. Such features, modifications or embodiments are, therefore, considered to be a part of this invention, the scope of which is to be determined by the following claims.

The invention claimed is:

1. An apparatus comprising:

an aperture panel with a plurality of apertures;

a gate panel secured to said aperture panel with a plurality of gates, each said gate being relatively the same dimension as a respective said aperture and wherein each said gate is substantially aligned with said respective said aperture when said gate panel is in contact with said aperture panel and wherein said gate panel further comprises a perforated region that surrounds each said gate and is substantially greater in size than each said gate; and a tab panel at least partially secured to said gate panel, said tab panel defining a tab panel perimeter and a plurality of substantially detachable tabs within said tab panel perimeter, each said tab being approximately dimensioned with said perforated region of a respective said gate so that each said tab is substantially aligned with said perforated region of said respective said gate when said tab panel is in contact with said gate panel.

2. The apparatus of claim 1 wherein said tab panel is at least partially secured to said aperture panel.

3. The apparatus of claim 1 further comprising at least one display panel secured to at least one of the following group consisting of said aperture panel, said tab panel, or said gate panel.

4. The apparatus of claim 1 wherein said gate panel is smaller than said aperture panel.

5. The apparatus of claim 1 wherein said gate panel, said tab panel, and said aperture panel are formed from the same substrate by partially cutting and folding said substrate.

6. The apparatus of claim 5 wherein said substrate has an adhesive compound on at least one side.

7. The apparatus of claim 1 wherein each said gate is either partially or fully detachable from said gate panel.

8. A package comprising:

a package blank with an aperture panel with a plurality of apertures, a gate panel secured to said aperture panel with a plurality of gates, each said gate is substantially dimensioned with a respective said aperture so that each said gate is substantially aligned with said respective said aperture when said gate panel is in contact with said aperture panel and wherein said gate panel further comprises a perforated region that surrounds each said gate and is substantially greater in size than each said gate, and a tab panel secured to said gate panel with a plurality of tabs, each said tab being approximately dimensioned with said perforated region of a respective said gate so that each said tab is substantially aligned with said perforated region of said respective said gate when said tab panel is in contact with said gate panel; and a blister tray wherein at least some portion of said blister tray protrudes through said plurality of apertures and wherein at least some portion of said blister tray is in contact with said aperture panel and wherein said gate panel is in contact with at least some portion of said blister tray and wherein said tab panel is in contact with at least some portion of said gate panel.

9. The package of claim 8 wherein said tab panel is in contact with at least some portion of said aperture panel.

10. A method of forming a package comprising the steps of:

providing an aperture panel and forming a plurality of apertures on said aperture panel;

providing a gate panel and forming a plurality of gates on said gate panel, wherein each said gate is approximately dimensioned with a respective said aperture so that each said gate is substantially aligned with said respective said aperture when said gate panel is in contact with said aperture panel and forming a perforated region that surrounds each said gate and is substantially greater in size than each said gate;

providing a tab panel and forming a plurality of tabs on said tab panel, wherein each said tab is approximately dimensioned with said perforated region of a respective said gate so that each said tab is substantially aligned with said perforated region of said respective said gate when said tab panel is in contact with said gate panel;

providing a blister tray;

contacting said blister tray to said aperture panel so that at least one blister cell of said blister tray substantially protrudes through each said aperture;

securing said gate panel to said aperture panel; and securing said tab panel to said gate panel.

11. The method of claim 10 wherein said gate panel is secured to at least some portion of said blister tray.

12. The method of claim 10 wherein at least some portion of said tab panel is secured to at least some portion of the aperture panel.

13. An apparatus comprising:

an aperture panel with a plurality of apertures;

a gate panel secured to the aperture panel, said gate panel defining a plurality of gates, each said gate being relatively the same dimension as a corresponding said aperture and being substantially aligned therewith when the gate panel is in contact with the aperture panel, said gate panel further comprising a plurality of perforated regions, each said perforated region surrounding a respective said gate and being substantially greater in size than said gate respective said gate; and a tab panel at least partially secured to the gate panel, said tab panel defining a plurality of substantially detachable tabs, each said tab being approximately dimensioned with a corresponding said perforated region and positioned so as to be substantially aligned with the corresponding said perforated region when the tab panel is in contact with the gate panel.

14. The apparatus of claim 4 wherein said tab panel is in contact with, and secured to, at least some portion of said aperture panel.

15. The package of claim 9 wherein said gate panel is smaller than said aperture panel and wherein said tab panel is secured to said at least some portion of said aperture panel in a face contacting relationship.

16. The apparatus of claim 13 wherein said gate panel is smaller than said aperture panel and wherein said tab panel is secured to at least some portion of said aperture panel in a face contacting relationship.

* * * * *